US008327565B2

(12) United States Patent
Boltz et al.

(10) Patent No.: US 8,327,565 B2
(45) Date of Patent: Dec. 11, 2012

(54) FENCE WRAPPING ASSEMBLY AND A METHOD OF UTILIZING THE SAME

(75) Inventors: Eric S. Boltz, Akron, OH (US); Scott A. Miller, Navarre, OH (US); Erik M. Baker, Massillon, OH (US)

(73) Assignee: Imaginethis Renovations, LLC, Navarre, OH (US)

( * ) Notice: Subject to any disclaimer, the term of this patent is extended or adjusted under 35 U.S.C. 154(b) by 170 days.

(21) Appl. No.: 12/892,216

(22) Filed: Sep. 28, 2010

(65) Prior Publication Data

US 2012/0073170 A1 Mar. 29, 2012

(51) Int. Cl.
*E04H 17/06* (2006.01)

(52) U.S. Cl. ..... 40/603; 40/606.18; 256/24

(58) Field of Classification Search ..... 40/603, 40/604, 606.18, 607, 607.05; 256/1, 24, 256/32

See application file for complete search history.

(56) References Cited

U.S. PATENT DOCUMENTS

| | | | | |
|---|---|---|---|---|
| 2,540,584 | A | 2/1951 | Jaycox | |
| 3,537,201 | A | 11/1970 | Huey et al. | |
| 3,589,048 | A * | 6/1971 | Mollet et al. | 40/603 |
| 4,375,134 | A | 3/1983 | Sheetz | |
| 4,879,848 | A | 11/1989 | Gardner et al. | |
| 4,890,403 | A | 1/1990 | Dinan | |
| 4,932,152 | A | 6/1990 | Barlotta et al. | |
| 5,090,145 | A | 2/1992 | Chiang et al. | |
| 5,246,194 | A | 9/1993 | Garcia | |
| 5,305,704 | A | 4/1994 | Olaniyan | |
| 5,333,425 | A | 8/1994 | Nickerson et al. | |
| 5,402,988 | A * | 4/1995 | Eisele | 256/24 |
| 5,407,178 | A * | 4/1995 | Long | 256/45 |
| 5,555,659 | A | 9/1996 | Hade | |
| 5,667,855 | A | 9/1997 | Borden et al. | |
| 5,685,099 | A * | 11/1997 | Favata | 40/590 |
| 5,732,494 | A | 3/1998 | Davey | |
| 5,916,091 | A | 6/1999 | Schultz | |
| 5,921,031 | A | 7/1999 | Williams | |
| 6,474,009 | B2 | 11/2002 | Hahn | |
| 6,510,663 | B2 | 1/2003 | Jourden et al. | |
| 6,530,165 | B2 | 3/2003 | Griesemer et al. | |
| 6,619,544 | B2 | 9/2003 | Bator et al. | |
| 6,719,276 | B1 * | 4/2004 | Bush | 256/1 |
| 7,240,637 | B2 * | 7/2007 | Rosen | 119/524 |
| 7,437,843 | B2 | 10/2008 | Lefebvre | |
| 7,997,560 | B2 * | 8/2011 | Bergdoll | 256/24 |
| 2004/0221972 | A1 | 11/2004 | Tomlinson et al. | |
| 2007/0209261 | A1 | 9/2007 | Stover et al. | |
| 2009/0266958 | A1 | 10/2009 | Meersman et al. | |

* cited by examiner

*Primary Examiner* — Casandra Davis
(74) *Attorney, Agent, or Firm* — Sand & Sebolt

(57) ABSTRACT

A fence wrapping assembly for retaining a panel of sheet material adjacent one or both of a front and back of a fence. The panel has one or more pockets formed therein; a carrier is received in each pocket and a mounting member engages each carrier and secures the same to one of a first and second fence post. A tensioning device extends between the first and second fence posts and engages the panel. The device is adjustable to apply tension to the panel. Advertising graphics are applied to the panel's exterior surface.

23 Claims, 8 Drawing Sheets

FENCE WRAPPING ASSEMBLY AND A METHOD OF UTILIZING THE SAME

BACKGROUND OF THE INVENTION

1. Technical Field

The invention relates generally to a fence wrapping assembly. More particularly, the invention relates to a fence wrapping assembly for mounting panels of sheet material to at least one of the front and back of a fence. Specifically, the invention relates to a fence wrapping assembly which mounts and tensions panels of sheet material onto frames that are themselves secured to fence posts.

2. Background Information

Advertising is a large industry in the United States and includes both printed media and electronic formats. Printed media comes in a variety of forms and may include banners and advertising billboards.

While advertising banners or panels are well known in the advertising industry, they are typically mounted to a support structure by passing string or wire through eyelets in the corners of the panels and then wrapping that string around portions of the support structure. The banner length must generally be of a size suitable to fit within the area defined by the support structure or an unsightly amount of string will be necessary to secure the panel in place. Banners may also be used in smaller venues such as high school football stadiums, along fences, or on the back of a bleacher. While the panel or banner may adequately display an image, this mounting method does not look very professional is not particularly aesthetically pleasing. There is therefore a need in the art for an improved manner of displaying advertising panels and banners on support structures, especially on fences.

Additionally, apart from being used to display advertising on fences, there are other times when it is desirable to secure one or more panels of sheet material onto a fence. One such instance is the use of sheet material panels to substantially reduce the amount of snow that drifts or blows across an area, such as alongside the edges of a road.

There is therefore a need in the art for an improved assembly for wrapping panels of sheet material to a support structure, such as a fence, and which will make it quicker and easier to secure the panel in place and to remove it therefrom, and which will ensure that the sheet material covers the fence to the desired degree without sagging.

BRIEF SUMMARY OF THE INVENTION

The device of the present invention is a fence wrapping assembly for retaining a panel of sheet material adjacent one or both of a front and back of a fence. The panel has one or more pockets formed therein; a carrier is received in each pocket and a mounting member engages each carrier and secures the same to one of a first and second fence post. A tensioning device extends between the first and second fence posts and engages the panel. The device is adjustable to apply tension to the panel. Advertising graphics are applied to the panel's exterior surface.

BRIEF DESCRIPTION OF THE SEVERAL VIEWS OF THE DRAWINGS

A preferred embodiment of the invention, illustrative of the best mode in which Applicant contemplates applying the principles, is set forth in the following description and is shown in the drawings and is particularly and distinctly pointed out and set forth in the appended claims. Similar numbers refer to similar parts throughout the drawings.

DETAILED DESCRIPTION OF THE INVENTION

Figure 1:
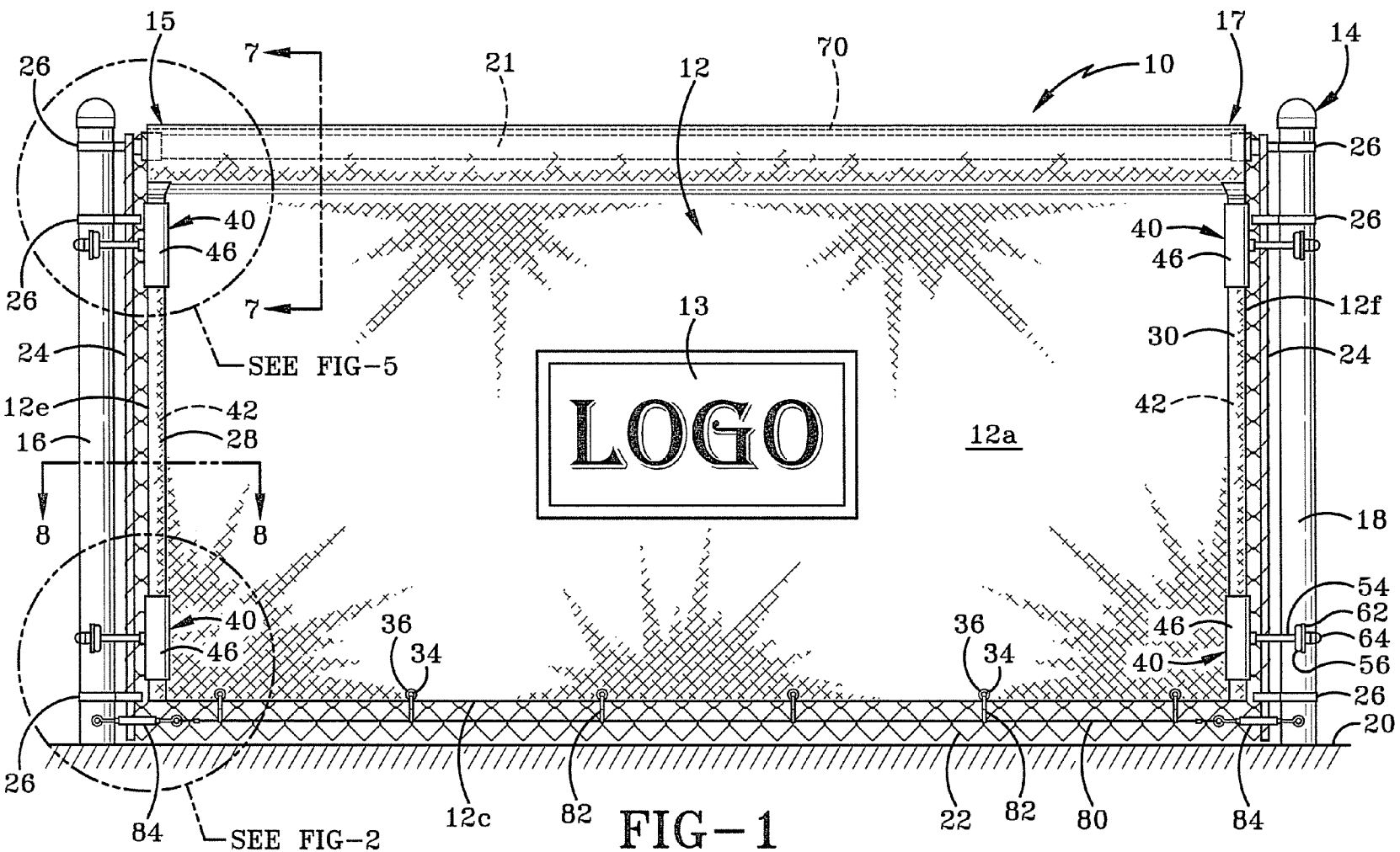
FIG. 1 is a front plan view of a fence having a sheet material panel wrapped thereon in accordance with the present invention.
Figure 2:
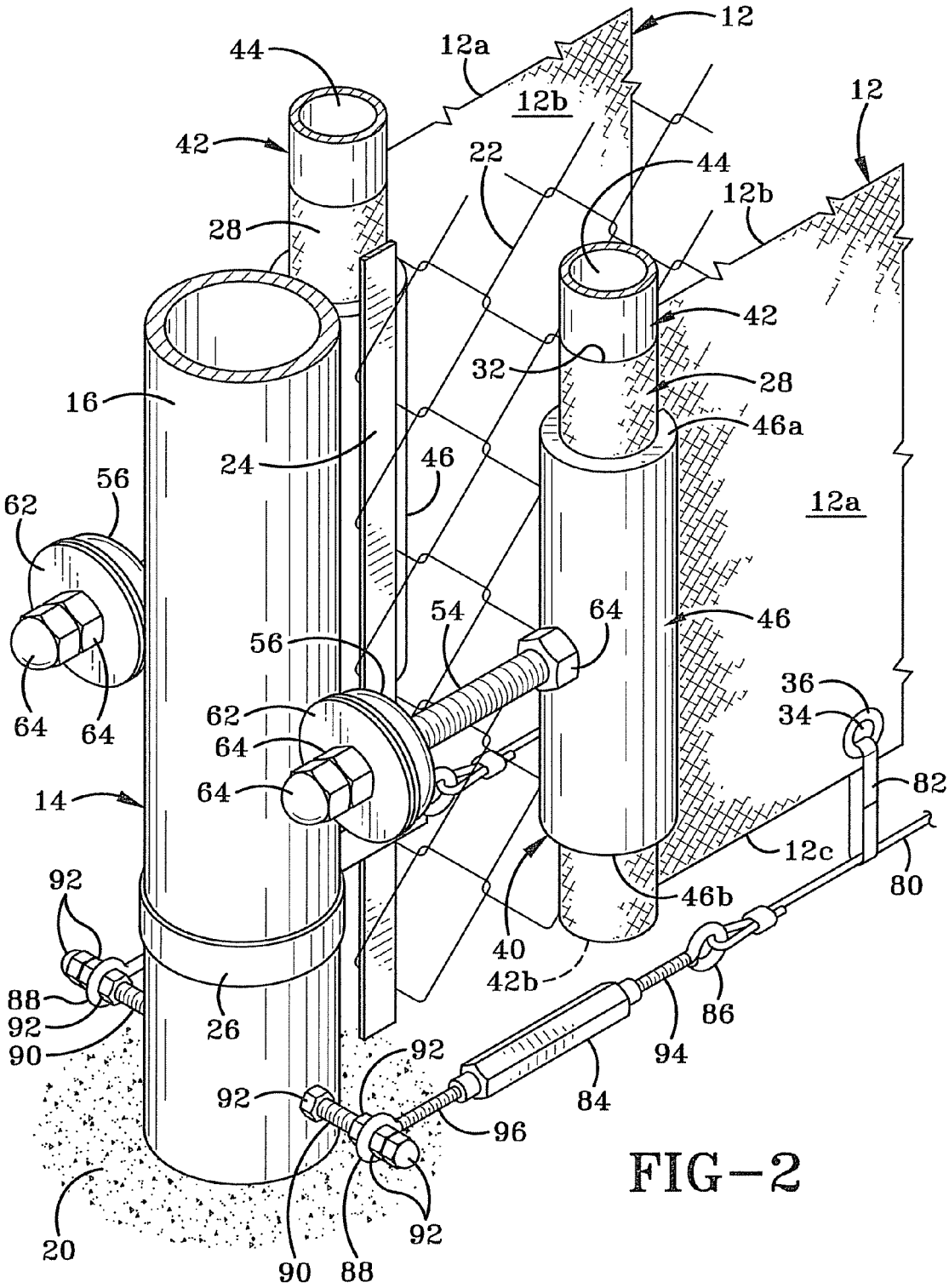
FIG. 2 is an enlarged perspective view of the highlighted bottom left hand area of FIG. 1.

Referring to FIGS. 1-8, there is shown a fence wrapping assembly in accordance with the present invention and generally indicated at 10. Wrapping assembly 10 comprises a panel 12 of sheet material and a support assembly 40 to secure panel 12 to a fence 14, as will be hereinafter described.

Fence 14 comprises one or more fence sections that each include a pair of fence posts 16, 18 that extend vertically upward from a surface 20 and are spaced a distance horizontally apart from each other. A stabilizer bar 21 extends between posts 16, 18 and a section of fencing material 22 extends downwardly from bar 21 and horizontally between posts 16 and 18. Fencing material 22 includes a top end 22*a* that is attached to bar 21, a rear surface 22*b*, and a front surface 22*c*. FIGS. 1-8 illustrate one particular fencing material, wire, being secured between posts 16, 18. The side edges of the wire fencing material 22 are each secured to a vertically oriented support member 24 which, in turn, is secured to one of posts 16, 18 by any suitable manner such as one or more support straps 26. It should be understood that any type of fencing material other than wire can also extend between posts 16, 18. These other materials include, but not limited to any type of sheet material such as metal, vinyl, glass and plastic, or wood or vinyl rails and spindles.

As indicated previously, wrapping assembly 10 comprises the panel 12 of sheet material and support assembly 40. Support assembly 40 supports panel 12, secures panel 12 to fence 14 and tensions the sheet material of panel 12.

Panel 12 preferably is manufactured from a sheet material such as vinyl or any other suitable fabric such as cotton. Panel 12 has an exterior surface 12*a*, an interior surface 12*b*, a first end 12*c*, a second end 12*d* (FIG. 4), a left side 12*e* and a right side 12*f*. In accordance with one of the specific features of the present invention, one or more graphic images 13 may be printed or otherwise applied to exterior surface 12*a* of panel 12. The graphic images may be advertising text and images that are applied directly to the sheet material by printing, for example, or they could be woven or formed into the actual sheet material itself. Alternatively, graphic images 13 may be provided on an additional panel (not shown) that is secured to the exterior surface 12*a* of panel 12 by an adhesive, by hook and loop fasteners or any type of securement means such as sewing or rivets.

Figure 3A:
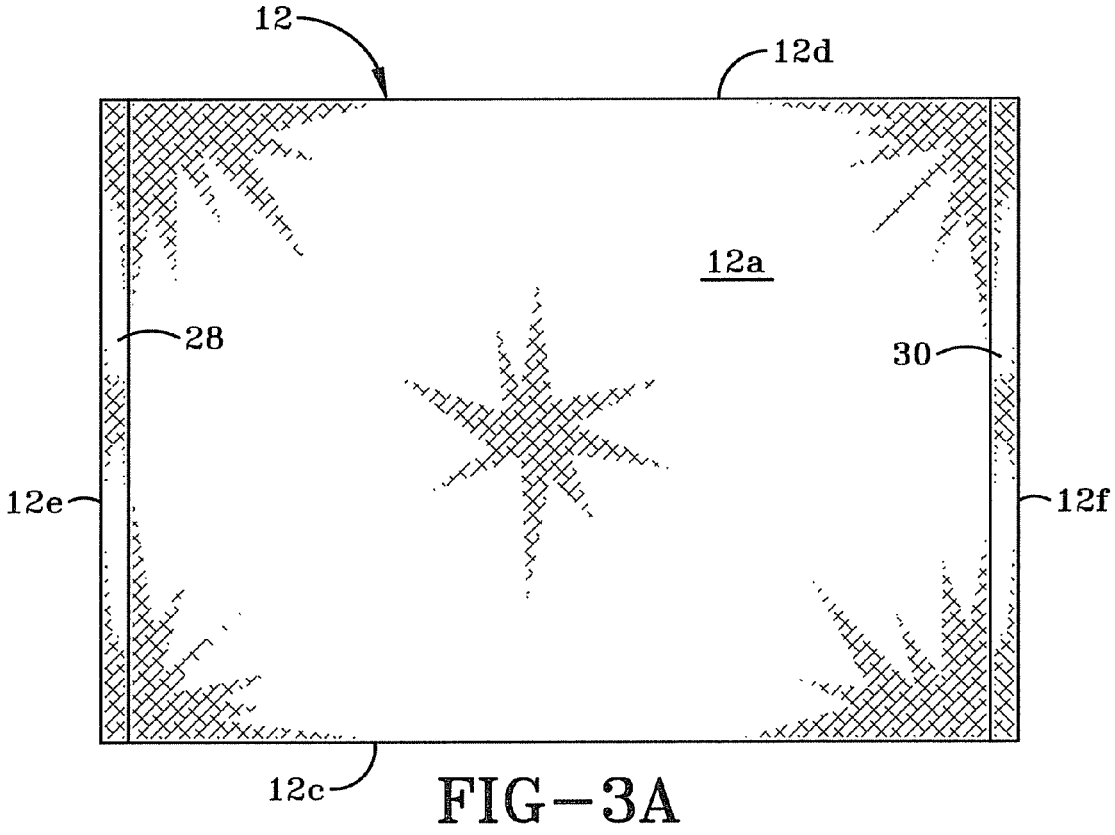
FIG. 3*a* is a plan view of a first embodiment of a panel in accordance with the present invention, showing pockets formed along the side edges of the panel and extending from one end of the panel to the other.
Figure 3B:
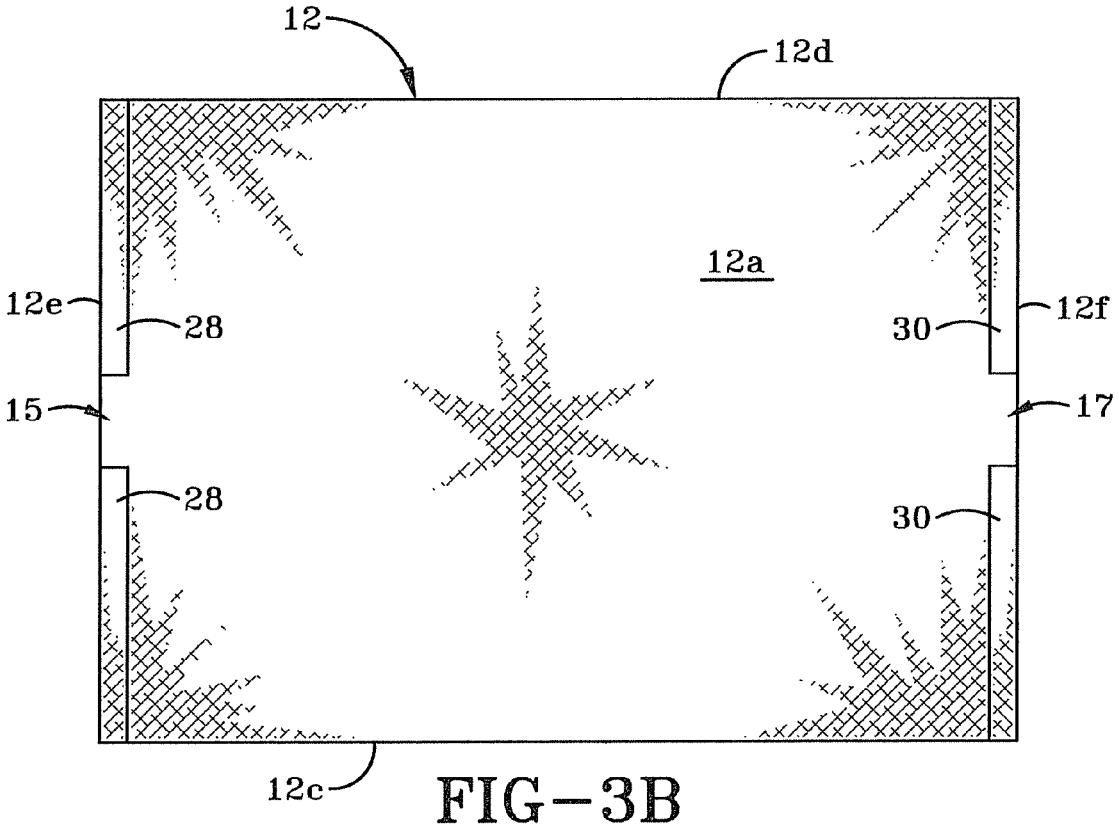
FIG. 3*b* is a plan view of a second embodiment of a panel in accordance with the present invention, showing pockets formed along the side edges of the panel and arising proximate one of the ends and extending inwardly for a distance, with the two pockets along the same side edge being separated from each other.
Figure 7:
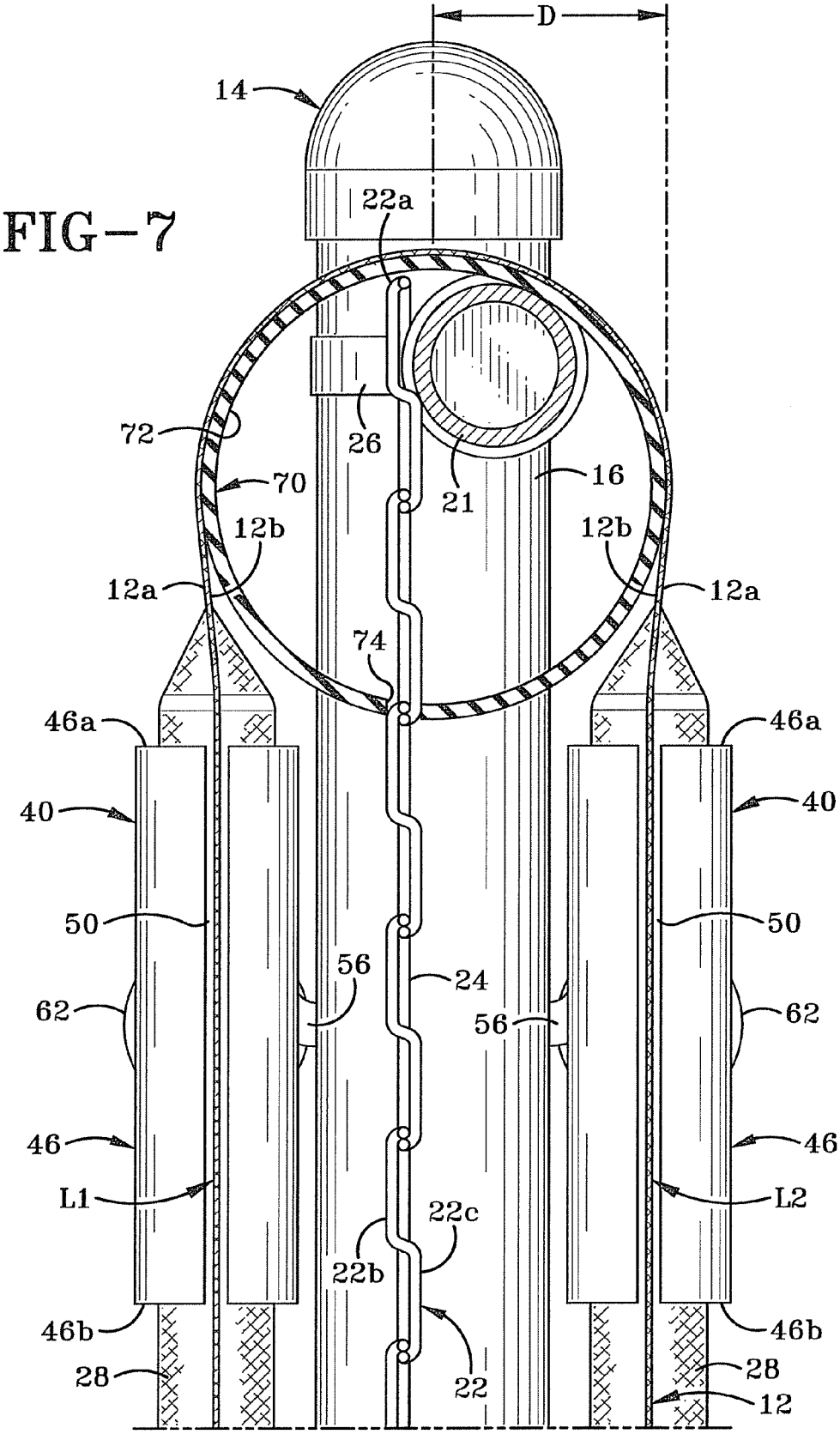
FIG. 7 is a right side view of the upper left hand area of the fence assembly taken through line 7-7 of FIG. 1.
Figure 8:
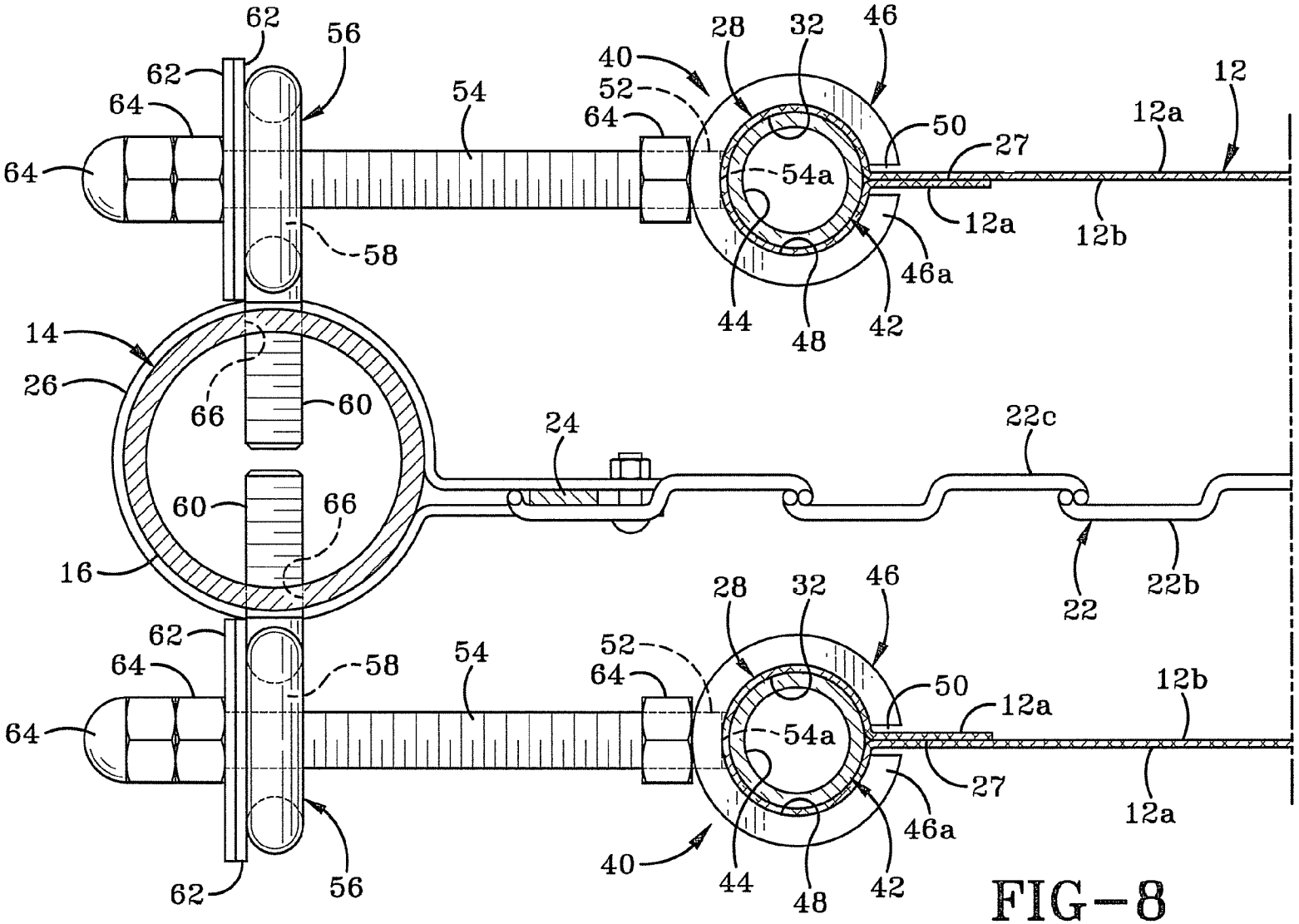
FIG. 8 is a top view of the bottom left hand corner of the fence assembly taken through line 8-8 of FIG. 1.

In accordance with yet another specific feature of the present invention, a portion of one or more of left side 12*e*, right side 12*f*, first end 12*c* and second end 12*d* is turned back upon itself and is secured onto one of the exterior and interior surfaces 12*a*, 12*b* of panel 12 to form a seam 27 (FIG. 8). In this manner, a pocket region is formed along one or more of left side 12*e*, right side 12*f*, first end 12*c* and second end 12*d*. FIGS. 1-8 illustrate a pocket 28 formed along left side 12*e* and a pocket 30 formed along right side 12*f*. If panel 12 is designed to be positioned adjacent only one of the front and rear surfaces of fence 22, then pockets 28, 30 preferably will extend from first end 12*c* through to second end 12*d* (FIG. 3*a*). Pockets 28, 30 may be closed off in a region that will fall proximate a top edge of fence 22 to give panel 12 a more aesthetically pleasing appearance. If panel 12 is to be wrapped around fence 22 so that both the front and back thereof are covered by panel 12, then pocket 28 may also extend from first end 12*c* through to second end 12*d* of panel 12 as is shown in FIG. 3*a*. If, as is illustrated in FIGS. 1-8, panel 12 is to be wrapped around fence 22 so that both the front and back of the fence are covered by panel 12, then a region 15 of left side edge 12*c* and a region 17 of right side edge 12*d* may be formed without a pocket 28, 30 therein. This is illustrated in FIG. 3*b*. Pockets 28, 30 will be closed off adjacent regions 15, 17 and open proximate first and second ends 12*c*, 12*d*. When panel 12 is wrapped on fence 12 as will be hereinafter described, regions 15, 17 will be disposed generally along the top edge of fence 22. Each pocket 28, 30 shown in FIG. 3*a* and FIG. 3*b* defines a tubular bore 32 (FIG. 4) therein. It should be understood that, preferably, panel 12 is a substantially continuous piece of sheet material.

Panel 12 further includes one or more holes 34 defined in the sheet material proximate one or both of first and second ends 12*c*, 12*d*. Holes 34 are spaced a distance horizontally apart from each other. Each hole 34 is surrounded by a grommet 36 that serves to strengthen the sheet material which surrounds and defines the hole 34. Grommets 36 thereby substantially aid in preventing damage to the sheet material when panel 12 is tensioned, as will be hereinafter described.

In accordance with a specific feature of the present invention, the support assembly 40 includes one or more carriers 42 that are each sized to be received in bore 32 of one of pockets 28, 30. If panel 12 is used to cover only one of the front and back surfaces of fence 22, then the carriers 42 may extend from first end 12*c* through to 12*d* thereof. If panel 12 is used to wrap over a top end 22*a* of fence 22 and the panel 12 is made in the manner illustrated in FIG. 3*a*, then carriers 42 are inserted into each of pockets 28, 30 but preferably will terminate a short distance from top end 22*a* of fence. It will be understood, however, that if carriers 42 are manufactured from a sufficiently rigid yet flexible material, they could be inserted through the pockets 28, 30 as illustrated in FIG. 3*a* and extend from first end 12*c* to second end 12*d*, and right over the top end 22*a* of fence 22. If the panel 12 used is manufactured in the manner illustrated in FIG. 3*b*, then carriers 42 are inserted up to the closed top end of each pocket 28, 30.

Figure 4:
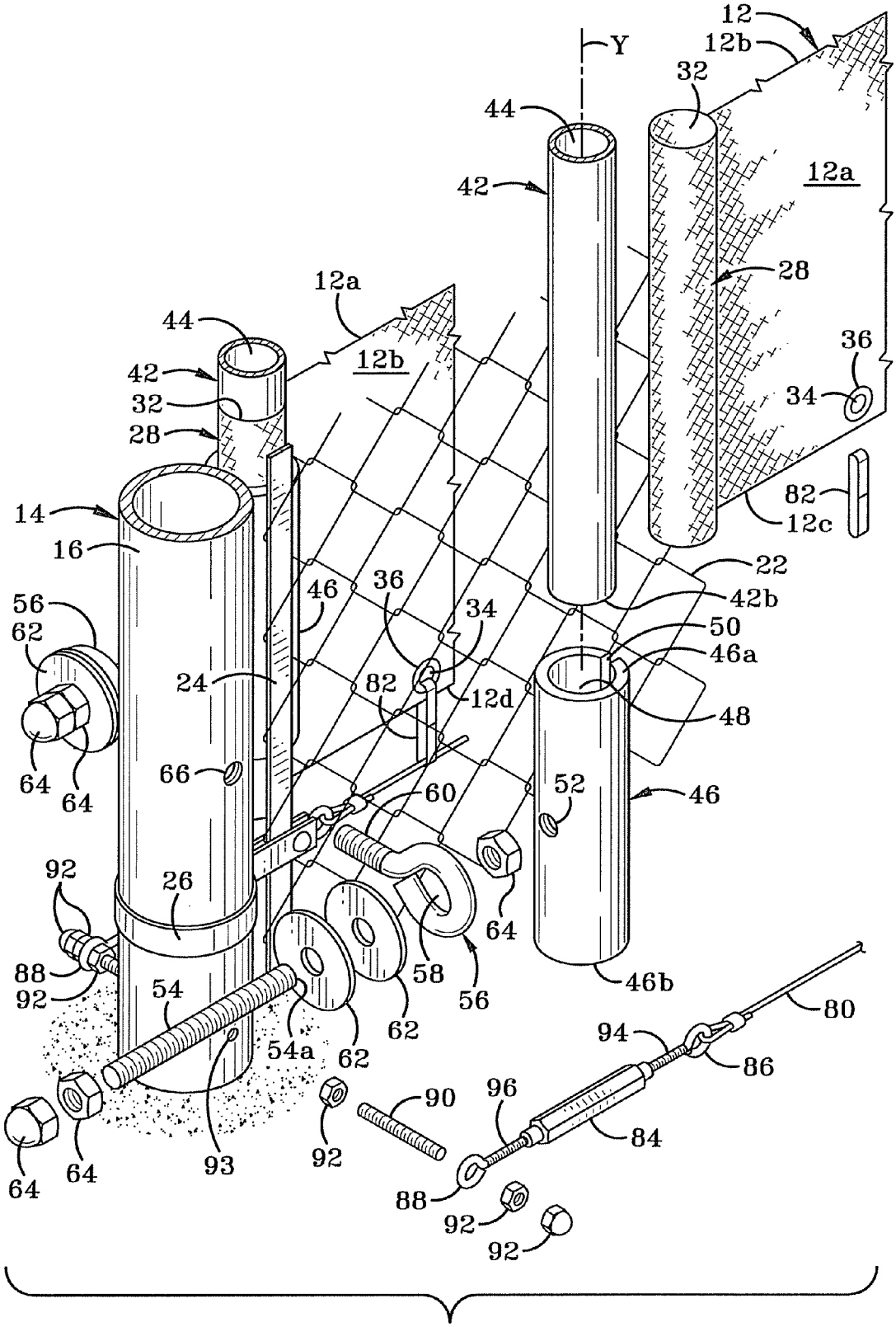
FIG. 4 is an exploded view of FIG. 2.
Figure 5:
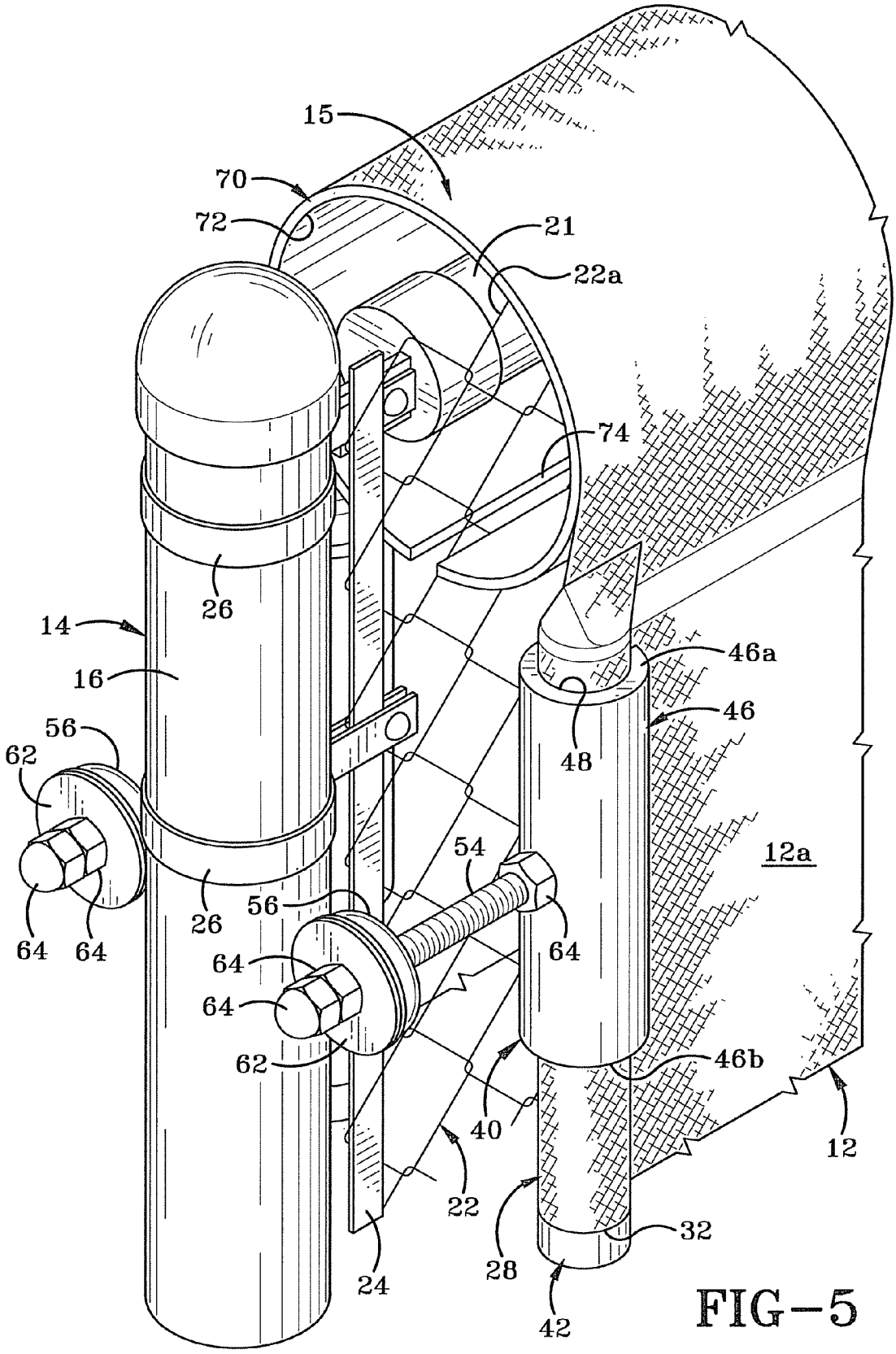
FIG. 5 is an enlarged perspective view of the highlighted upper left hand area of FIG. 1.
Figure 6:
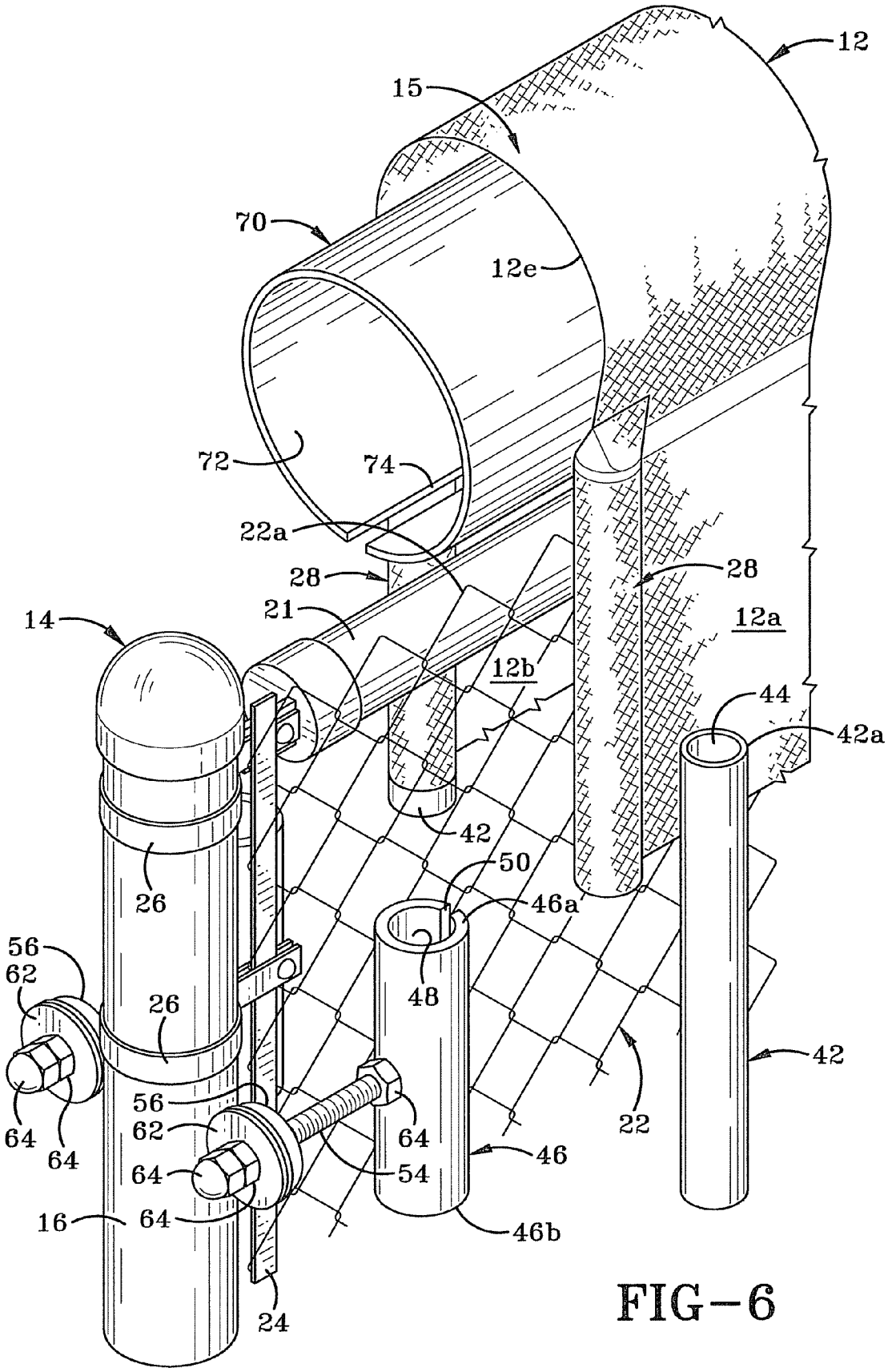
FIG. 6 is an exploded view of FIG. 5.

Carrier 42 is illustrated as a cylindrical tube defining a central bore 44 that extends longitudinally therethrough. The longitudinal axis "Y" of carrier 42 is shown in FIG. 4. It should be understood however, that, in accordance with the present invention, carrier 42 can be of any cross-sectional shape along its length. So, for example, carrier 42 could be octagonal or pentagonal in cross-sectional shape or could simply be a flat length of a rigid material such as a metal rod. Furthermore, carrier 42 may be cross-sectionally wider in one region than in another. So, for example, carrier 42 could be wider proximate the top end 42*a* (FIG. 6) than proximate the bottom end 42*b* (FIG. 4). Furthermore, carrier 42 could be a substantially solid member instead of being a hollow, tubular member.

Carriers 42 are substantially rigid and supportive in nature. When inserted into the bore 32 of one of pockets 28, 30, carriers 42 support the sheet material of panel 12 along substantially the entire length of carrier 42 and thereby substantially prevent the material from folding, sagging or collapsing inwardly on itself. The sheet material preferably is a vinyl or fabric material that would fold or sag if not adequately supported or tensioned.

Support assembly 40 further includes a plurality of mounting members 46 that each engage one of the carriers 42 and one of the first and second posts 16, 18. The position of each mounting members 46 along the length of the associated carrier 42 is adjustable to ensure the proper tension is attained in panel 12, as will be hereinafter described.

In the preferred embodiment of the invention illustrated in FIGS. 1-8, mounting member 46 is a cylindrical tube that defines a longitudinal bore 48 therein. Bore 48 is sized to receive carrier 42 therethrough. Bore 48 may be complementary in shape to the cross-sectional external shape of carrier 42, but the two may differ. Preferably, there is not an interference fit between mounting member 46 and carrier 42 so that carrier 42 may be easily inserted into and removed from bore 48.

In accordance with a specific feature of the present invention, mounting member 46 is provided with a longitudinally aligned slot 50 (FIG. 4) that extends from one end 46*a* to the other end 46*b* thereof. When carrier 42 is received through bore 48 of mounting member 46, panel 12 extends outwardly through slot 50.

At least one aperture 52 is provided through the circumferential wall of mounting member 46. Preferably, aperture 52 is opposed to slot 48. A bolt 54 is sized to be received through aperture 52. Mounting assembly 40 further includes an eyebolt or eye lag 56 that includes a head defining an aperture 58 therein and a threaded end 60. Bolt 54 is passed through aperture 58 and through washers 62 and nuts and lock nuts 64 and is then screwed into aperture 52 in mounting member 46. Bolt 54 has a terminal end 54*a* that engages the exterior surface of panel 12 that is disposed around carrier 42 when carrier 42 is disposed in bore 48. When bolt 54 is screwed into engagement therewith, panel 12 is locked into place and carrier 42 is restrained against longitudinal movement relative to mounting member 44. Additionally, the tension in the sheet material of panel 12 is increased. When bolt 54 is screwed in the opposite direction and ceases to engage the exterior surface of carrier 42, then carrier 42 may be withdrawn from mounting member 46.

The threaded end 60 of eye bolt or eye lag 56 is threadably engaged in an aperture 66 in fence post 16. Bolt 54 and eye bolt or eye lag 56 thereby secure mounting member 46 to both the carrier 42 and to fence post 16. As illustrated in FIGS. 1-8, one or more mounting members 46 engage carriers 42 at spaced intervals along their length. Furthermore, mounting members 46 are secured by eye bolts 56 to both of the front and back regions of fence posts 16, 18. Thus, panel 16 is retained against both the front and back sides of fence 22.

In accordance with yet another aspect of the present invention, a top support member 70 is provided to support that portion of panel 12 that passes over the top edge 22*a* of fence 22. Preferably, top support member 70 is generally cylindrical in shape and defines a longitudinal bore 72 therethrough. Top support member 70 further defines a longitudinal slot 74 therethrough. Slot 74 permits the top support member 70 to be positioned over the top end 22*a* of fence 22 in such a manner that fence 22 extends outwardly through slot 74 as shown in FIG. 7. Top support member 70 preferably is manufactured from plastic or any other suitable material that may be flexed to allow the member 70 to be slipped over the top end 22*a* of the fence 22 and will then return to its original shape. Panel 12 passes over a portion of the exterior surface of top support member 70 and is thereby kept from contacting fence 22 and possibly being damaged thereby. Additionally, top support member 70 is of a diameter that is sufficient to ensure that panel 12 is kept at substantially the same distance "D" (FIG. 7) away from the front or back of the fence 22 from proximate first or second end 12*c*, 12*d* to adjacent the top end 22*a* of the fence 22. Consequently, the panel 12 from proximate the top of the fence 22 to the bottom of the panel is substantially in the same plane as is shown in FIG. 7.

In accordance with yet another specific feature of the present invention, a tensioning cable 80 is secured between fence post 16 and fence post 18. A plurality of links 82 extend between cable 80 and the holes 34 proximate first and second ends 12*c*, 12*d* of panel 12. Links 82 pass through the grommeted holes 34 and are disposed substantially at right angles to cable 80. A rotatable tensioning member 84 is provided on at least one end of cable 80. Tensioning member 84 includes a first eyelet 86 through which cable 80 is passed and a second eyelet 88 through which a bolt 90 is passed. Bolt 90 is threadably engaged in an aperture in one of fence posts 16, 18. Nuts 92 secure bolt 90 in place. Tensioning member 84 further includes threaded regions 94, 96. Tensioning member 84 may be rotated in a first direction to move first eyelet 86 away from fence post 16 and in a second direction to draw first eyelet 86 toward fence post 16. When first eyelet 86 is moved away from fence post 16, the tension in cable 80 is reduced, and when first eyelet 86 is moved in the opposite direction, the tension in cable 80 is increased. This allows the installer to ensure that panel 12 is pulled sufficiently taut to remove any wrinkles or folds that will detract from the aesthetic appearance of the panel 12.

The fence wrapping assembly 10 of the present invention is used in the following manner. Top support member 70 is slipped over top end 22*a* of fence 22 by separating it so that top end 22*a* slips into bore 72 thereof through slot 74. The installer places panel 12 over top support member 70 so that regions 15, 17 are disposed on uppermost region of top support member 70 and a first length L1 (FIG. 7) of panel 12 hangs downwardly from top support member 70 and adjacent rear surface 22*b* of fence 22. First length L1 is the length of panel 12 that hangs adjacent the back 22*b* of fence 22. A second length L2 of panel 12 hangs downwardly from top support member 70 and adjacent front surface 22*c* of fence 22. Second length L2 of panel 12 is that portion of the panel that hangs adjacent the front 22*c* of fence 22. Carriers 42 are inserted into pockets 28, 30 either at this point or immediately before panel 12 is draped over top support member 70. The installer positions a top end 46*a* of a mounting members 46 longitudinally adjacent a bottom end 42*b* of one of the pocket-enclosed carriers 42 and slides mounting member 46 onto the same. The installer must ensure that panel 12 slides into slot 50 of mounting member 46. Mounting member 46 is slid upwardly along the pocket-enclosed carrier 42 until a desired position on panel 12 is reached. The installer installs all of the mounting members 46 in this manner.

Each mounting member 46 is then engaged with one of posts 16, 18. This is accomplished by screwing an eyebolt 56 into the appropriate aperture 66 in post 16 (or 18) and then screwing a bolt 54, with the associated washers 62 and nuts 64, into aperture 52 in mounting member 46. At the point, the installer may elect to engage the first and second ends 12*c*, 12*d* of panel with tensioning cable 80 by engaging links 82 around cable 80 and in holes 34 on panel 12. Bolt 90 is threaded through eyelet 88 through nut 92 and into aperture 93 (FIG. 4) of post 16. The installer is able to adjust the position of each mounting member 46 along the length of the carrier 42 with which it is engaged and can slide mounting member 46 along the longitudinal axis "Y" of carrier 42 until the optimum support of panel 12 is attained. Through a series of adjustments of the positions of the various mounting members 46 and of the tensioning cable 80 and tensioning device 86, the installer is able to place panel 12 under tension in such a manner that substantially all folds and wrinkles are removed therefrom. The installer rotates bolts 54 to the point that the terminal ends 54*a* thereof engage the pocket-enclosed carrier 42 and retain the same in abutting contact with the interior wall of mounting member 46. Bolts 54 thereby prevent relative motion between mounting member 46 and carrier 42. Specifically, longitudinal sliding motion between mounting member 46 and carrier 42 is prevented. At the same time, the engagement of bolts 54 secures panel 12 in position relative to posts 16, 18. The installer also rotates tensioning device 86 in one of a first and second direction to pull panel 12 taut. This enables the graphic images 13 on the exterior surface 12*a* of panel 12 to be clearly visible. If graphic images 13 are applied from first end 12*c* to second end 12*d* of panel 12, then observers will be able to see the graphic images 13 on either side of fence 22.

When it is desired to remove panel 12 from fence 22, the installer rotates bolts 90, 54 in the opposite direction. Cable 80 is removed, mounting members 46 are slid off pocket enclosed carriers 42 and panel 12 is lifted off top support member 70.

If so desired, mounting members 46 can be permanently mounted on posts 16, 18 as can tensioning cable 80 and top support member 70. Then panels 12 with differing graphic images 13 can be periodically wrapped on fence 22. Alternatively, to make installation a little easier, eyebolts 56 can be left permanently on posts 16, 18 as can tensioning cable 80 and top support member 70. Mounting members 46 can be engaged with carriers 42 that are inserted into pockets 28, 30 on different panels 12, and then all that needs to happen to install panel 12 is that the installer engage bolts 54 with mounting members 46 once panel 12 is draped over top support member 70 and engage links 82 with cable 80.

It should be understood that pockets 28, 30 may be permanently formed as by heating sealing the sheet material to itself, the pockets may instead be formed by temporarily securing one layer of sheet material to the other, such as by using a hook and loop fastener.

It should further be understood that while it is described above that carriers 42 may be removably received in any of the pockets 28, 30 in panel 12, those carriers 42 may, instead, be permanently sealed in pockets 28, 30.

While the above has described how to wrap a fence with a panel 12 containing graphic images 13 for advertising purposes, it will be understood that a fence 22 could be similarly wrapped with a panel 12 for other purpose such as minimizing the passage of drifting and blowing snow from one side of the fence to the other, blocking wind, or increasing privacy. It will be understood that the size panel 12, the sheet material from which the panel is manufactured, and the size and length fence 22 which may be wrapped may be varied to suit any situation.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. In combination:

a fence comprising a first post and a second post spaced a distance from each other, and fencing extending between the first and second posts and including a front surface, a top surface, and a rear surface; and a fence wrapping assembly engageable with the fence, said fence wrapping assembly comprising:

a panel of sheet material;

a first pocket formed in the panel;

a first carrier received in the first pocket; and a first mounting member engageable with both the first carrier and one of the first and second fence posts, and when said first mounting member is so engaged, the panel of sheet material is retained adjacent at least one of the front and rear surfaces of the fencing.

2. The combination as defined in claim 1, wherein the fence wrapping assembly further comprises a second mounting member engageable with the first carrier a spaced distance from the first mounting member, and said second mounting member is engageable with the one of the first and second posts a spaced distance from the first mounting member.

3. The combination as defined in claim 1, wherein the first pocket is formed along a first section of the first edge of the panel and the fence wrapping assembly further comprises:

a second pocket formed along a second section of the first edge of the panel a spaced distance from the first pocket; and a second carrier is received in the second pocket; and wherein the panel of sheet material is draped over the top surface of the fencing so that the first and second pockets are disposed adjacent the first post and on opposite sides of the fencing; and a first portion of the panel including the first pocket is disposed adjacent the front surface of the fencing and a second portion of the panel including the second pocket is disposed adjacent the rear surface of the fencing, and wherein the first mounting member is engaged with a front region of the first post and a second mounting member is engaged with a rear region of the first post, and the first mounting member retains the first portion of the panel adjacent the front surface of the fencing and the second mounting member retains the second portion of the panel adjacent the rear surface of the fencing.

4. The combination as defined in claim 3, wherein the first and second pockets formed along the first side edge of the panel are aligned with each other.

5. The combination as defined in claim 4 wherein the fence wrapping assembly further includes a third mounting member engageable with the second carrier when disposed in the second pocket, and the third mounting member further engages the rear of the first fence post a spaced distance from the second mounting member.

6. The combination as defined in claim 5, further comprising a fourth mounting member that is engageable with the first carrier when in the first pocket, and the fourth mounting member is engageable with the first carrier a spaced distance from the first mounting member, and wherein the fourth mounting member is further engageable with the front of the first post.

7. The combination as defined in claim 4, wherein the first pocket arises in a first edge of the panel and terminates in a terminal edge a distance spaced from the first edge, and the second pocket arises in a second edge of the panel opposite the first edge and terminates in a terminal edge spaced from the second edge, and wherein the terminal edges of the first and second pockets are spaced a distance from each other.

8. The combination as defined in claim 7, wherein a pocket free region is formed on the panel between the first and second pockets, and the pocket free region extends between the terminal edges of the first and second pockets.

9. The combination as defined in claim 8, wherein the fence wrapping assembly further includes a top support member, and the top support member is adapted to engage the top surface of the fencing; and wherein the pocket free region of the panel abuts the top support member when the top support member is engaged with the top surface of the fencing.

10. The combination as defined in claim 9, wherein the top support member has an exterior wall, and a longitudinal bore is defined in the exterior wall and extends from a first end of the exterior wall to a second end thereof; and the top support member further comprises a longitudinally aligned slot that extends from the first end to the second end of the exterior wall and is in communication with the bore; and when the top support member is engaged with the top surface of the fencing, a portion of the front and rear surfaces of the fencing extends outwardly from the slot.

11. The combination as defined in claim 1, wherein the fence wrapping assembly further comprises a second pocket formed along an opposite side edge of the panel from the first pocket; and a second carrier that is receivable in the second pocket, and wherein the first mounting member engages the first carrier when disposed in the first pocket and the second mounting member engages the second carrier when disposed in the second pocket, and the second mounting member secures the second carrier to the other of the first and second fence posts.

12. The combination as defined in claim 1, further comprising a tensioning member engageable with the panel and one or both of the first and second posts.

13. The combination as defined in claim 12, wherein the tensioning member comprises:

a cable having a first end and a second end;

a plurality of links extending between the cable and the panel, where the links engage the panel at spaced intervals; and an adjustable tensioning device, wherein a first end of the cable is connected to the first post, the second end of the cable is connected to the tensioning device, and the tensioning device is operationally connected to the second post.

14. The combination as defined in claim 13, wherein the tensioning device is adjustable in a first direction to increase the slack in the cable and is adjustable in a second direction to decrease the slack in the cable.

15. The combination as defined in claim 14, wherein the tensioning device is adjusted in a first direction by increasing the length of a bolt that connects the tensioning device to the one of the first and second fence posts, and the tensioning device is adjusted in the second direction by decreasing the length of the bolt that connects the tensioning device to the one of the first and second fence posts.

16. The combination as defined in claim 15, wherein the tensioning device is adjusted in a first direction by rotating it in a first direction and is adjusted in a second direction by rotating it in a second direction.

17. The combination as defined in claim 1, wherein the panel has an exterior surface and an interior surface, and the interior surface is adapted to be disposed adjacent one of the front and rear surfaces of the fencing, and wherein the panel further includes a graphic image provided on the exterior surface of the panel.

18. The combination as defined in claim 1, wherein the first mounting member comprises:

a tubular member having an exterior wall, a bore defined in the tubular member and extending longitudinally between a first and second end of the tubular member; and a longitudinally aligned slot defined in the exterior wall and extending between the first and second ends of the tubular member; said slot being in communication with the bore, and when the first carrier is retained in the first pocket and the first mounting member engages the first carrier, a portion of the panel extends outwardly from the slot.

19. The combination as defined in claim 18, wherein the mounting member further comprises:

a bolt, and an aperture formed in the exterior wall of the tubular member, the bolt being received in the aperture, and wherein rotation of the bolt in a first direction substantially prevents relative movement between the first carrier and the tubular member, and rotation of the bolt in a second direction permits relative movement between the first carrier and the tubular member.

20. The combination as defined in claim 19, wherein the mounting member further comprises:

an eyebolt adapted to be secured to the one of the first and second posts, an aperture defined in said eyebolt; the bolt being receivable through the aperture in the eyebolt and being securable to the eyebolt to operationally connect the mounting member to the one of the first and second posts.

21. The combination as defined in claim 1, wherein the panel is a substantially continuous piece of sheet material.

22. A method of displaying advertising comprising the steps of:

providing an advertising panel with a carrier at a perimeter;

attaching a mounting member to a fence post;

placing the advertising panel on a fence that is mounted on the fence post, such that a first portion of the panel is disposed adjacent a front surface of the fence;

engaging the mounting member with the carrier on the panel to retain the panel adjacent the front surface of the fence;

positioning a top support member over a top end of the fence;

placing the advertising panel over the top support member such that a second portion of the panel is disposed adjacent a rear surface of the fence; and tensioning the advertising panel.

23. The method as defined in claim 22, wherein the step of tensioning the advertising panel includes decreasing the length of a connector that extends between the fence post and a tensioning device secured to the advertising panel.

* * * * *